US011388515B2

(12) United States Patent
Lancaster

(10) Patent No.: US 11,388,515 B2
(45) Date of Patent: Jul. 12, 2022

(54) DAISY CHAINED AUDIO SPEAKER SYSTEM

(71) Applicant: Walter Lancaster, Los Angeles, CA (US)

(72) Inventor: Walter Lancaster, Los Angeles, CA (US)

( * ) Notice: Subject to any disclaimer, the term of this patent is extended or adjusted under 35 U.S.C. 154(b) by 13 days.

(21) Appl. No.: 16/209,664

(22) Filed: Dec. 4, 2018

(65) Prior Publication Data

US 2019/0222933 A1 Jul. 18, 2019

Related U.S. Application Data

(63) Continuation-in-part of application No. 14/757,036, filed on Jun. 22, 2014, now abandoned.

(51) Int. Cl.

| | |
|---|---|
| ***H04R 5/02*** | (2006.01) |
| ***H04R 3/12*** | (2006.01) |
| ***H04R 1/02*** | (2006.01) |
| ***H04R 5/04*** | (2006.01) |

(52) U.S. Cl.

CPC ..... *H04R 5/02* (2013.01); *H04R 1/026* (2013.01); *H04R 3/12* (2013.01); *H04R 5/04* (2013.01)

(58) Field of Classification Search

CPC . H04R 5/02; H04R 3/12; H04R 1/026; H04R 5/04

USPC ..... 381/75

See application file for complete search history.

(56) References Cited

U.S. PATENT DOCUMENTS

| | | | | |
|---|---|---|---|---|
| 6,594,370 | B1 * | 7/2003 | Anderson | H01Q 1/273 381/315 |
| 7,886,867 | B2 * | 2/2011 | Adams | H04R 1/025 181/148 |
| 2004/0122542 | A1 * | 6/2004 | Yang | H04M 1/6066 700/94 |
| 2007/0223761 | A1 * | 9/2007 | Fan | H04R 1/02 381/334 |
| 2008/0000714 | A1 * | 1/2008 | Adams | H04R 5/02 181/148 |
| 2014/0114142 | A1 * | 4/2014 | Shaoulian | A61B 5/332 600/301 |
| 2014/0205108 | A1 * | 7/2014 | Triato | H04R 5/0335 381/74 |

(Continued)

FOREIGN PATENT DOCUMENTS

| | | | | |
|---|---|---|---|---|
| CN | 204013990 U | * | 12/2014 | |
| EP | 2369816 A1 | * | 9/2011 | H04M 1/05 |
| JP | H01169113 U | * | 11/1989 | |

OTHER PUBLICATIONS

Daisy Chainable X-Mini II Orb Speakers, review Jan. 22, 2009 and Jan. 24, 2009; John Mahony, 4 pages. [2009].*

*Primary Examiner* — Amy R Weisberg

(57) ABSTRACT

A Daisy Chained Audio Speaker System comprising a plurality of audio speakers in cube cases wherein at end of the plurality is an electrical empowering voltage and amplitude audio input source line in wire comprising an audio jack wherein each of the audio speakers in cube cases in the plurality are configured spaced apart secured to an article of ornamental costume or genuine jewelry chain by tie wherein the jewelry chain is configured to be worn around the neck of a person and wherein the at end electrical empowering voltage and amplitude audio input source line in wire comprising an audio jack is configured to connect to an electrical empowering voltage and amplitude audio input source device.

1 Claim, 19 Drawing Sheets

(56) References Cited

U.S. PATENT DOCUMENTS

| | | | | |
|---|---|---|---|---|
| 2014/0270318 | A1* | 9/2014 | Cho | A44C 5/0015 381/385 |
| 2016/0095395 | A1* | 4/2016 | McRae | G08B 6/00 340/531 |
| 2016/0373849 | A1* | 12/2016 | Stoch | A44C 15/005 |
| 2018/0048952 | A1* | 2/2018 | Hong | G10K 11/175 |
| 2019/0215608 | A1* | 7/2019 | Takeshima | H04R 5/02 |

* cited by examiner

DAISY CHAINED AUDIO SPEAKER SYSTEM

FIELD OF INVENTION

A series of audio speakers connected by their respective positive and negative and or ground wire leads soldered to their respective positive and negative and or ground wire leads or to respective positive and negative and or ground wire leads of 2 Pin connectors selected and utilized herein example and this electrical connectivity manifests in a parallel electrical configuration wire harness as shown herein although could function with a series electrical configuration. The present invention provides means for audio reception and tele-communications and manifests as a plurality of cubed encased speaker components configured as harnessed spaced apart mounted to by fastening ties the article of jewelry of a chain ornamental or genuine to be expressly worn around the neck upon completion.

BACKGROUND OF THE INVENTION

Prior art to the present invention is any audio speaker system that is electrical wire harnessed that functions at its audio speaker numerical count with the introduction of an audio input source signal, these audio systems include home stereo speaker systems, automobiles, night clubs and arenas, movie theaters, audible alarms, ear plugs, headphones, stereo boom boxes, tabletop audio speaker systems, buildings, vessels airlines, boats, and submarines, and all intercom systems etc. Furthermore, uniquely herein the present invention, any article of jewelry known as a chain ornamental or genuine mounted to by fastening ties is the required host frame for the support of the present invention herein.

The present invention is new, unique and different from all prior art. The present invention is intended to be worn upon the body particularly around the neck.

The present invention combines the fashion and industry of jewelry manufacture ornamental or genuine and the industry and the manufacture of audio speakers.

SUMMARY OF INVENTION

Present invention must be mounted to by fastening ties to the requisite host of the article of jewelry of a chain ornamental or genuine to be expressly worn around the neck.

The disclosed exemplary embodiment's provide a present invention that when expressly worn around the neck mounted to by fastening ties to the article of jewelry of a chain ornamental or genuine presents with audio reception and tele-communications capabilities empowered by the voltage and amplitude of the audio input signal In one embodiment the present invention utilizes the connectivity of a 3.5 mm line-in audio jack male or female stereo or mono by wire connected to an external electrical empowering voltage and amplitude audio input source device.

BRIEF DESCRIPTION OF THE DRAWINGS

The teachings of the present application is described in detail for purposes of illustration, it is understood that such detail is solely for this purpose, and variations can be made without departing from the scope of the teachings of this application. The host frame of support of an article of jewelry of a chain ornamental or genuine is a must for the series of component parts as mounted to by fastening ties to complete a neck circumference as herein this present application.

In the following detailed portion of the present invention application, the teachings of the present application will be explained in more detail with reference to the example embodiment's shown in the drawings, in which.

Figure 17:
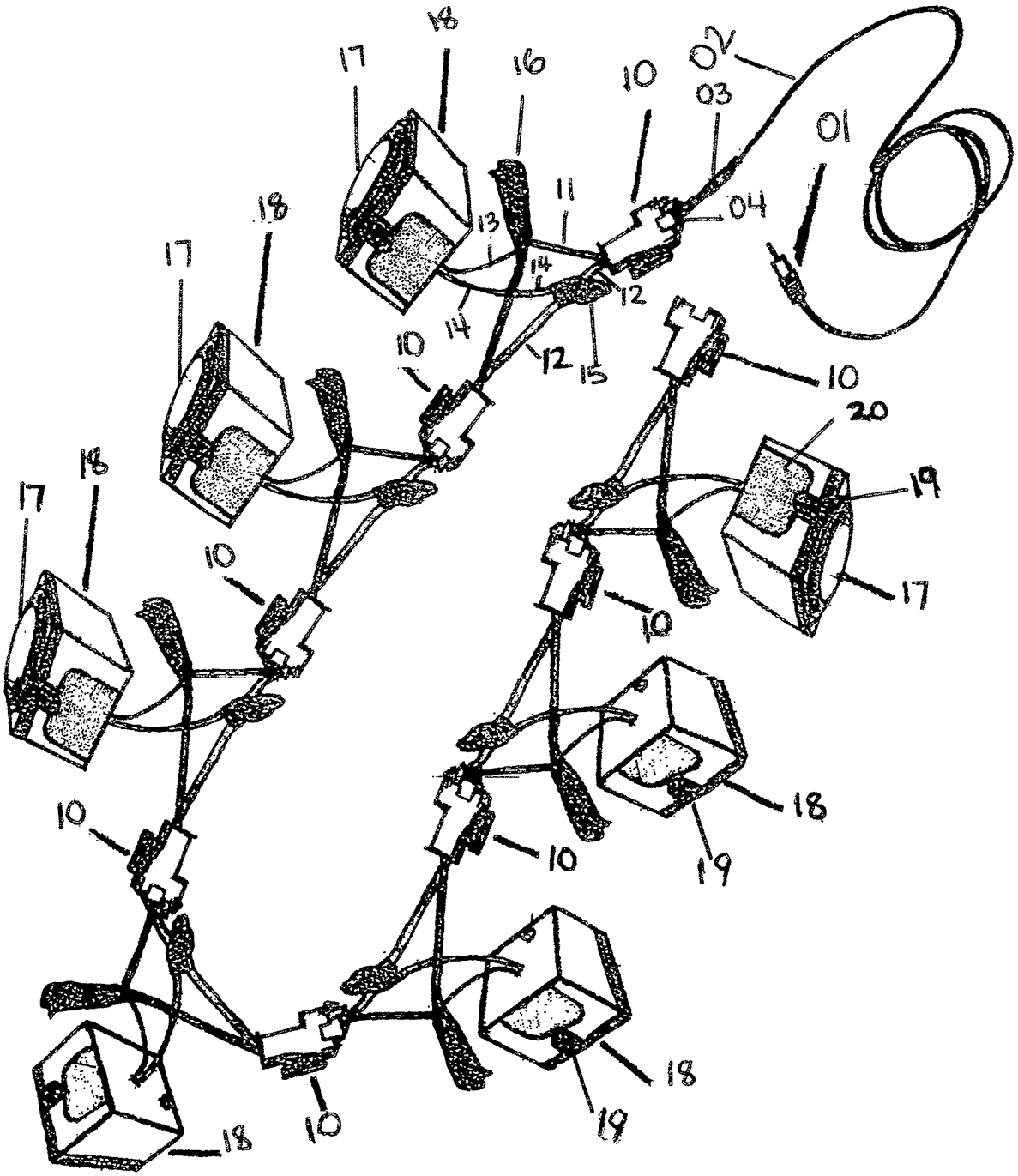
Figure 18:
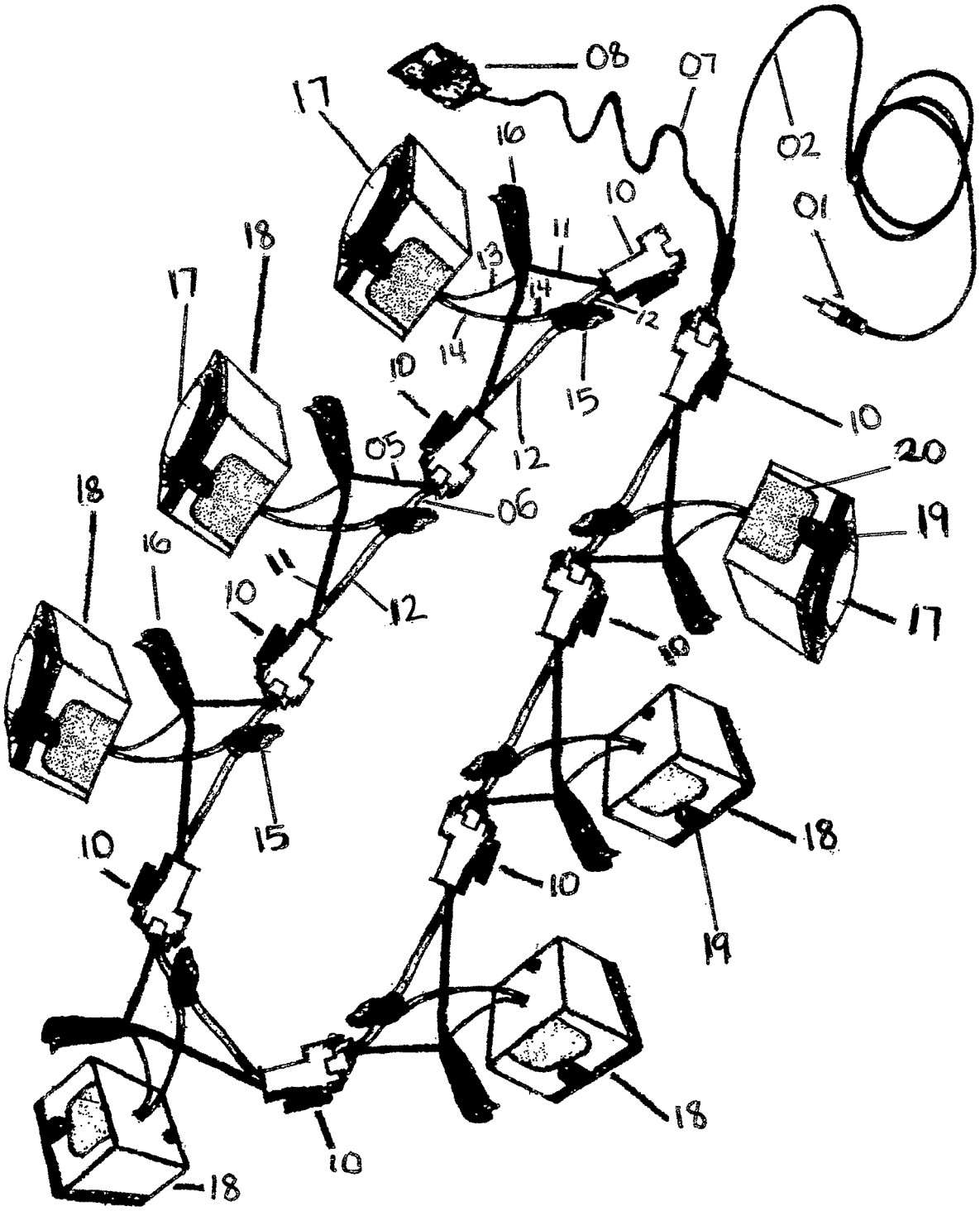
Figure 19:
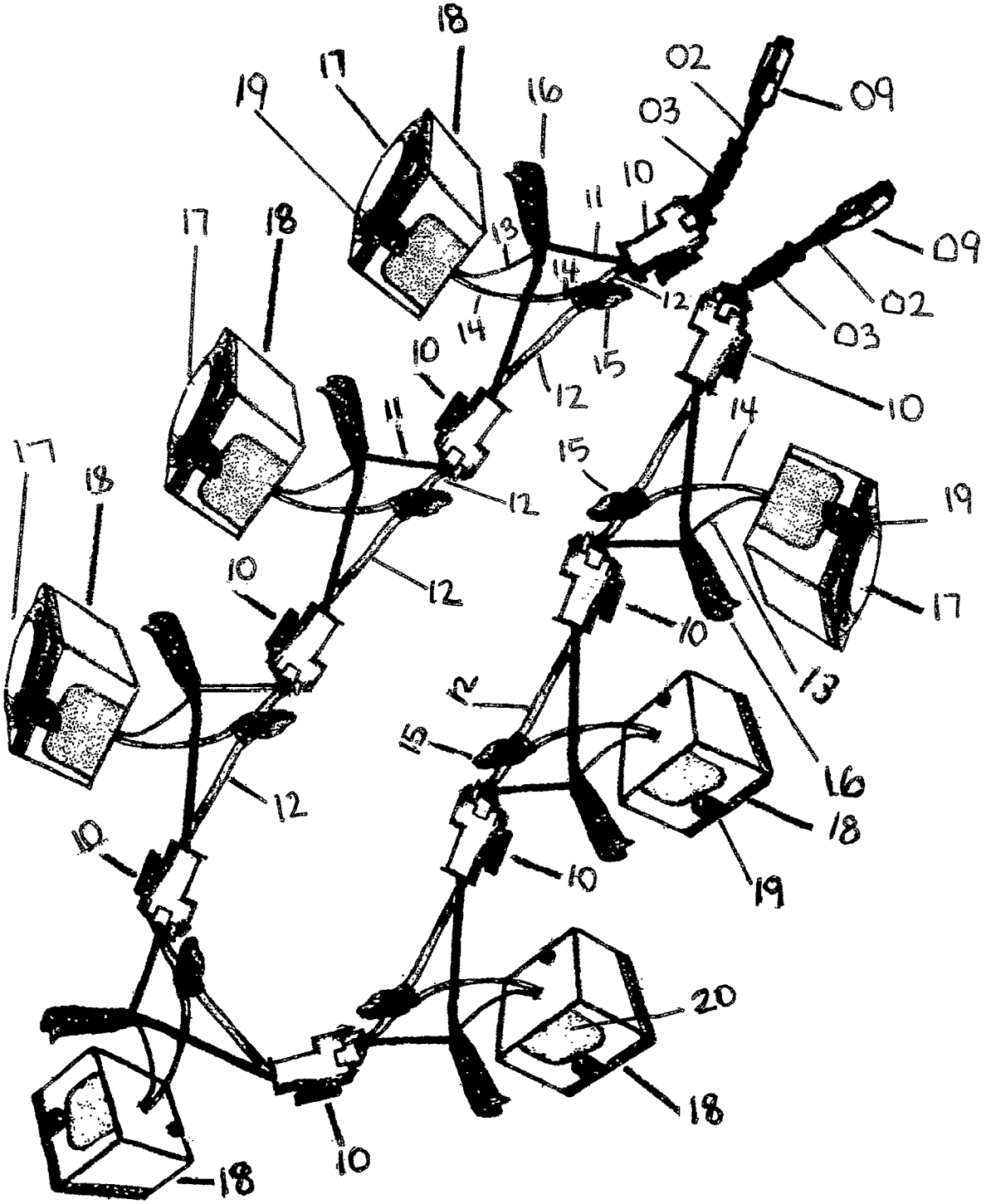

[05][06] at [15][16] as all component parts are to become connected for the resulting completed electrical wire harnessed series [FIG. 17][FIG. 18][FIG. 19].

Figure 11:
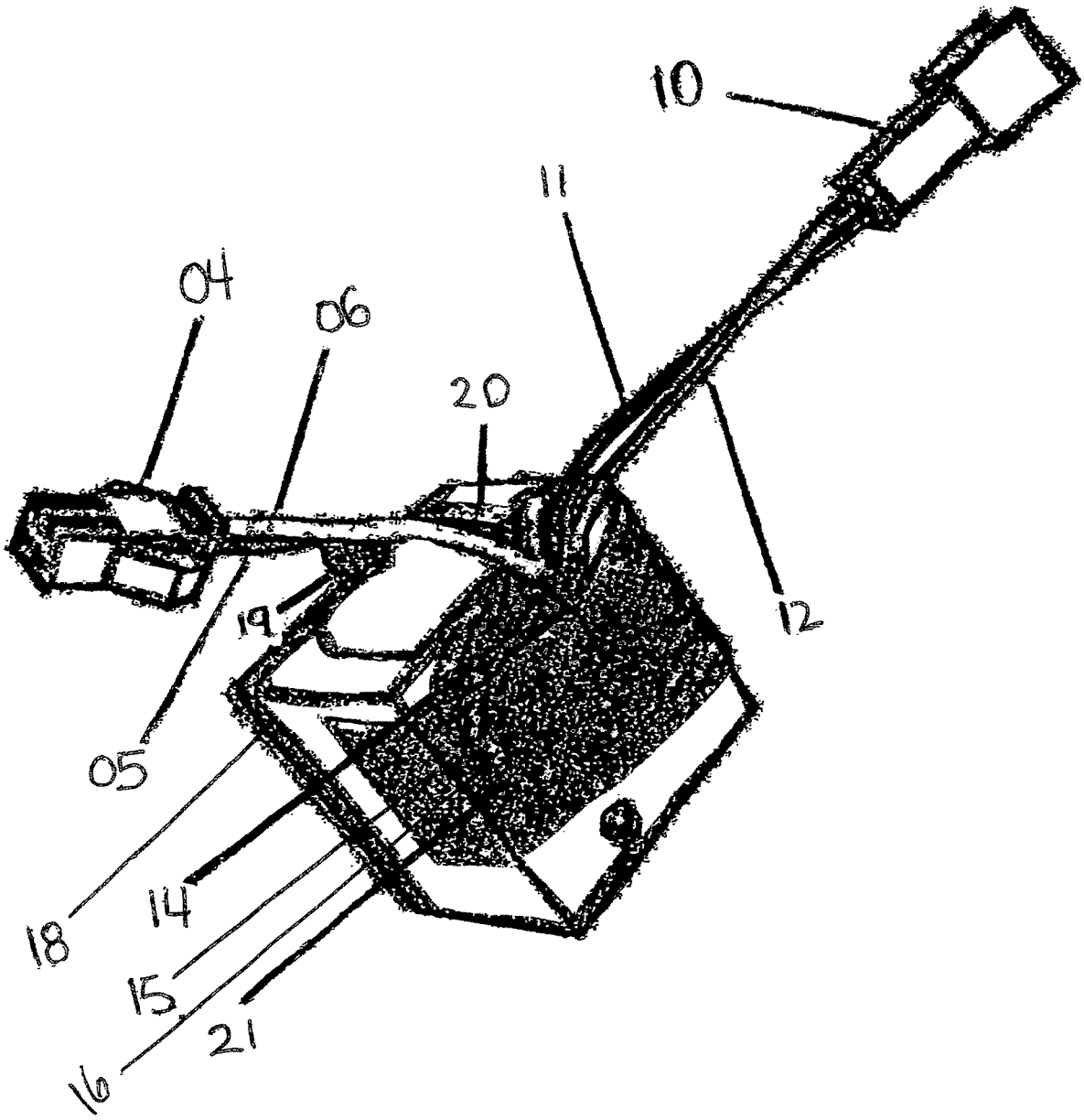

FIG. 11 is an Upper Rear View of another identical Audio Speaker [17] in Cube Case [18] connected by wire leads [13][14] to one female 2 Pin Connector [10] by wire leads[11][12] and to one male 2 Pin Connector [04] by wire leads [05][06] at [15][16] and sealed with electrical tape [21] as all component parts are to become connected for the resulting completed electrical wire harnessed series [FIG. 17][FIG. 18][FIG. 19].

Figure 12:
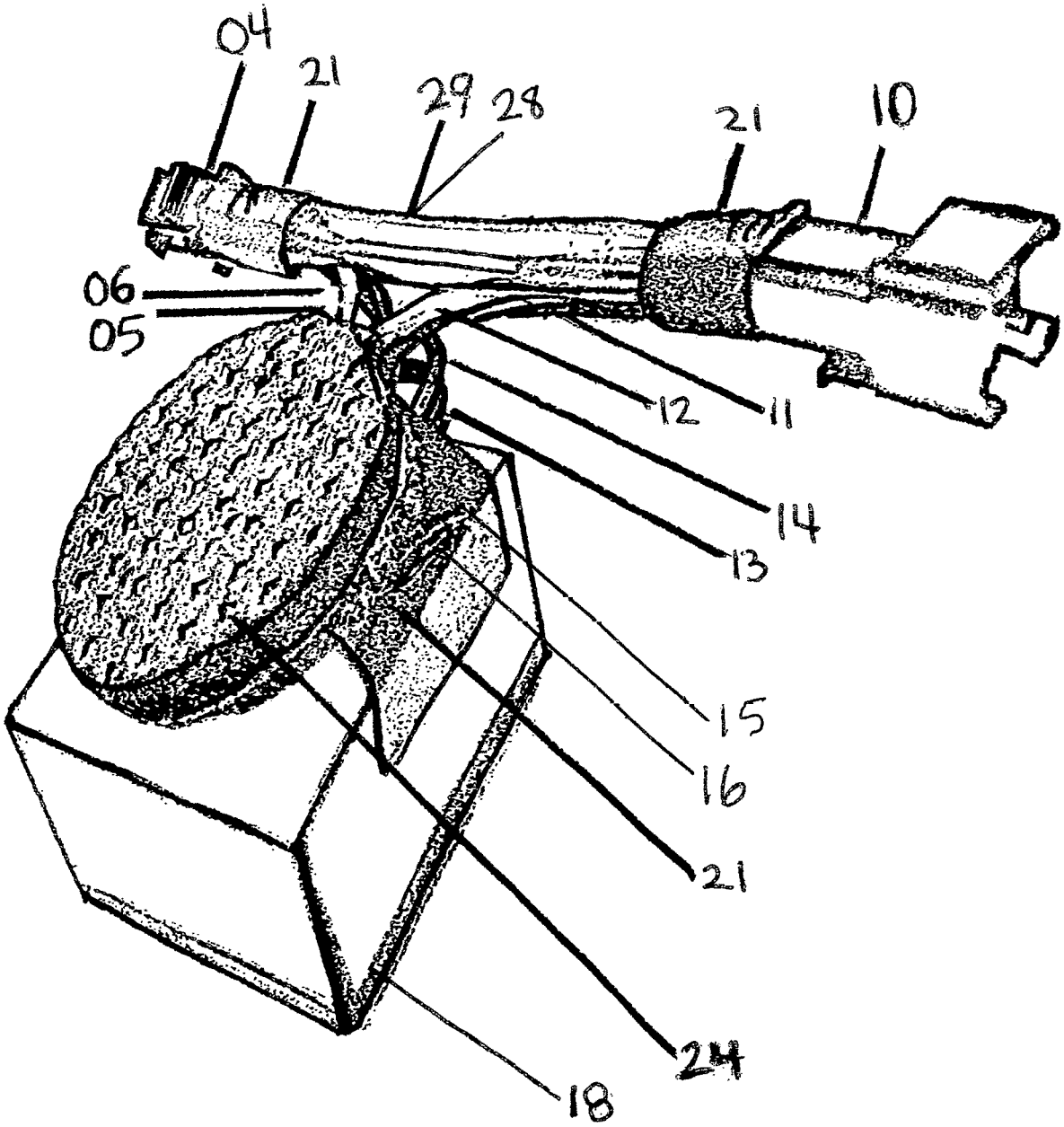

FIG. 12 is an Upper Rear View of another identical Audio Speaker [17] in Cube Case [18] connected by wire leads [13][14] to one female 2 Pin Connector [10] by wire leads [11][12] and to one male 2 Pin Connector [04] by wire leads [05][06] at [15[16] concealed in an optional flexible plastic tube [29] or coated and sealed with Acrylic layers [28] as all component parts are to become connected for the resulting completed electrical wire harnessed series [FIG. 17][FIG. 18][FIG. 19].

Figure 13:
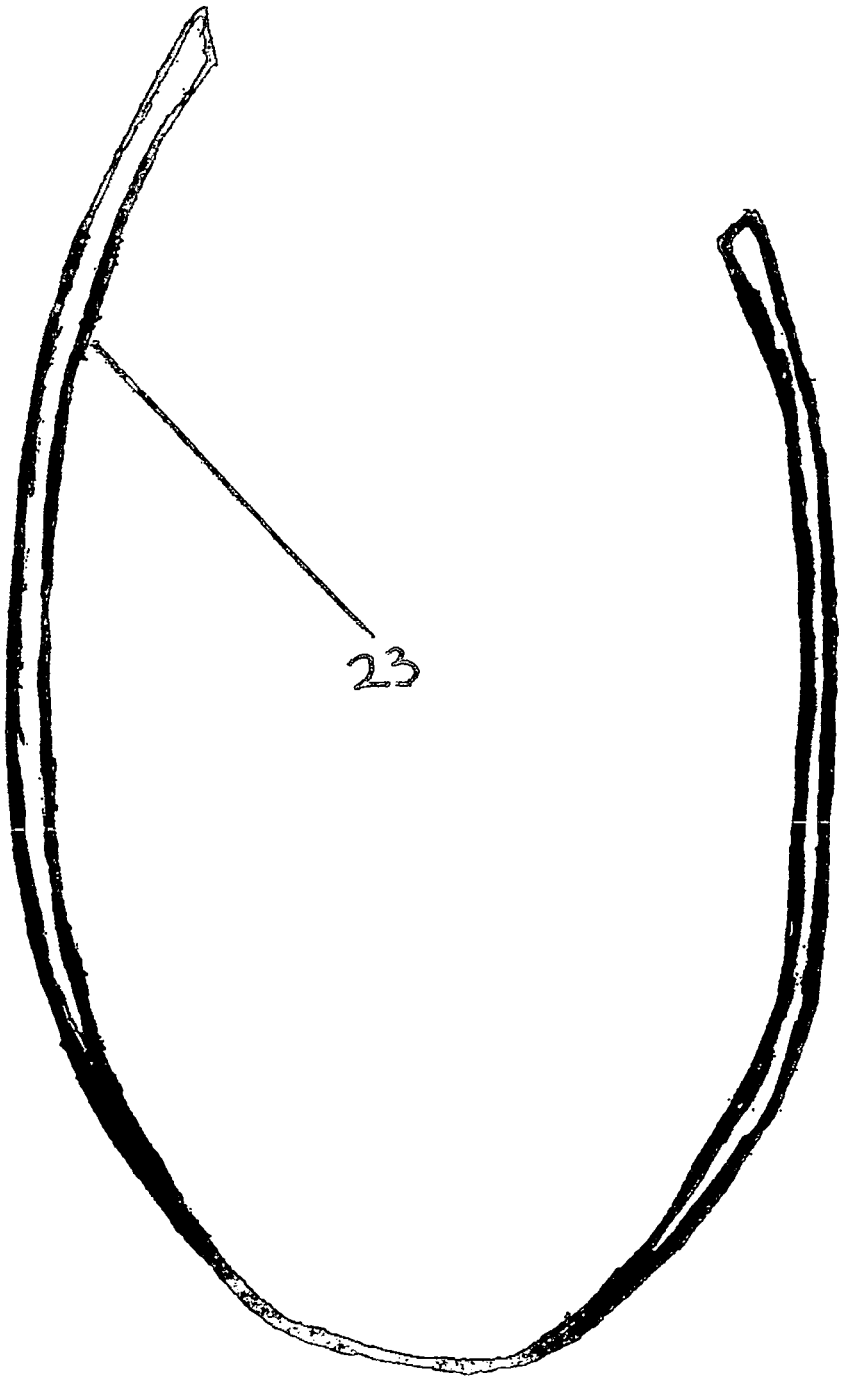

FIG. 13 is an Upper Front View of the optional Semi-Circle metal crossbar [23] used to maintain the Semi-Circular form of the article of jewelry of a Chain ornamental or genuine [25] when mounted to by fastening ties [27] to the completed electrical wire harnessed series [FIG. 17] [FIG. 18][FIG. 19].

Figure 14:
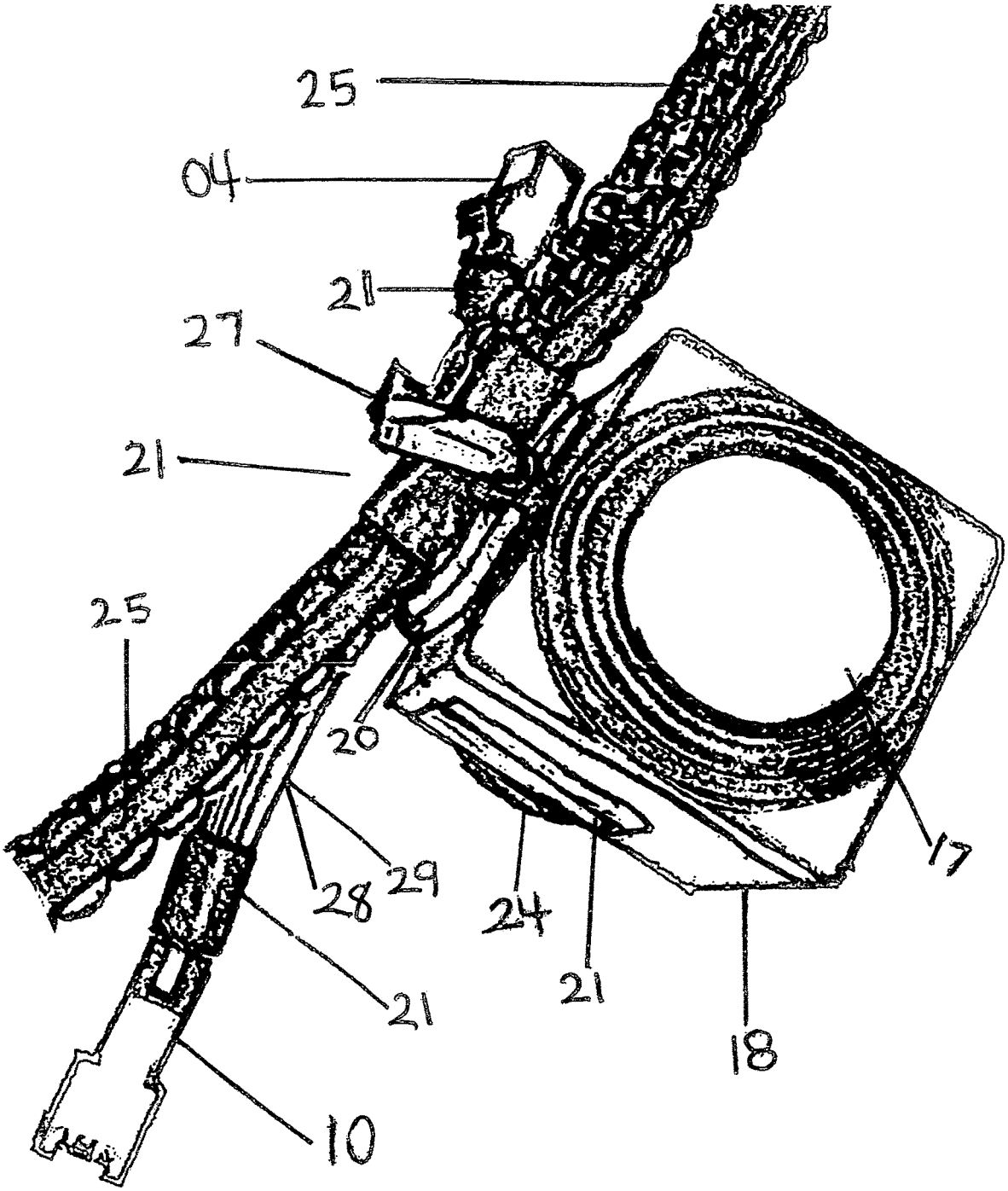

FIG. 14 is a Segmented front View of an identical Audio Speaker [17] in Cubed Case [18] of the chosen numerical count of six to seven for this particular model presented, as mounted to by fastening ties [27] the host frame support of the article of jewelry of a Chain ornamental or genuine [25].

Figure 15:
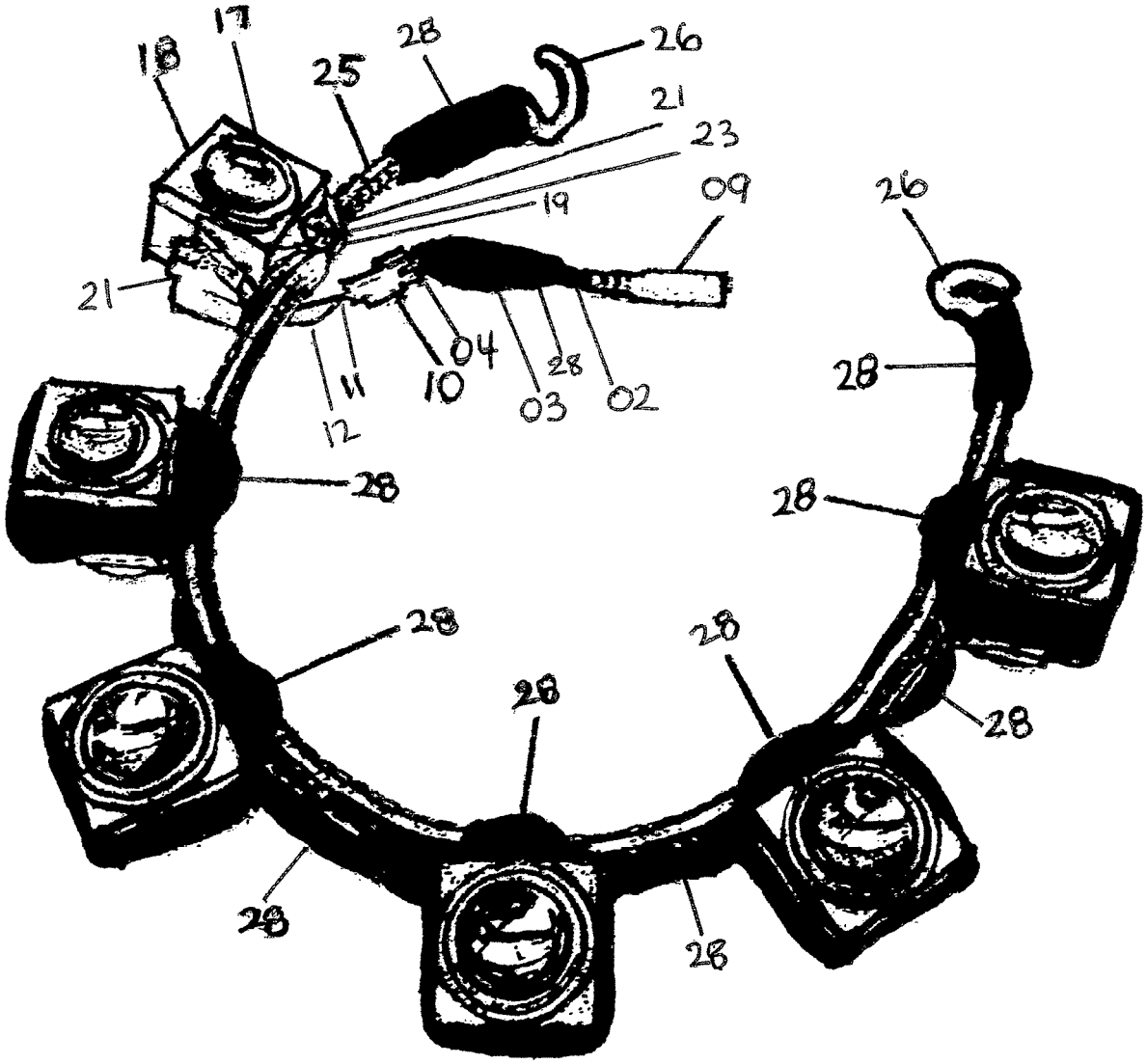

FIG. 15 is an Upper Front View of six count identical Audio Speaker [17] Cubed Cases [18] model of the present invention, as fully attached and mounted to by fastening ties [27] the requisite article of jewelry of a chain ornamental or genuine [25] the component connected by 2 Pin Connector parts [04][10] are now coated and sealed with Acrylic layers [28] although the Acrylic layers [28] can be any color [FIG. 15] is the present invention upon full completion.

Figure 16:
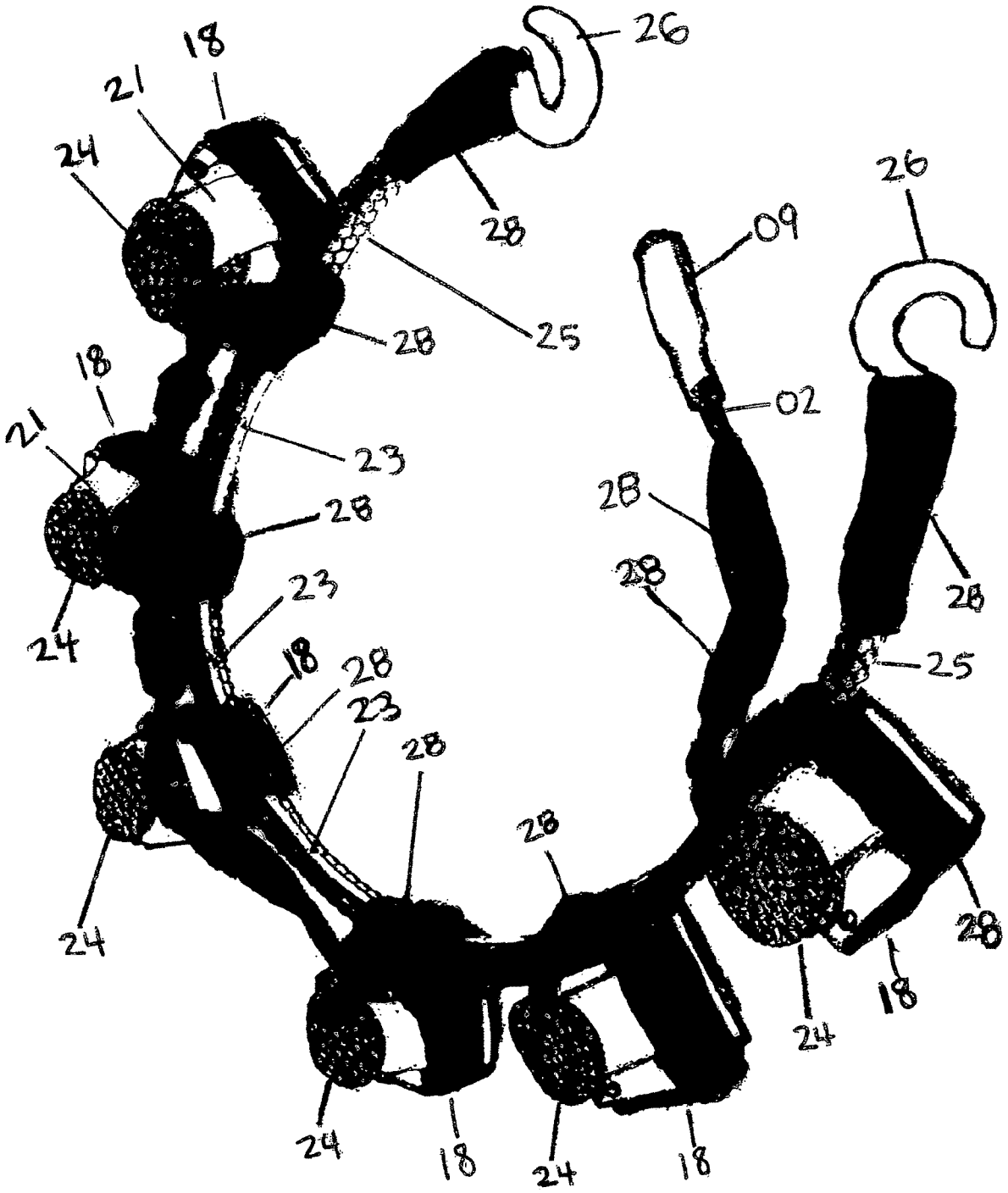

FIG. 16 is an Upper Rear View of six count identical Audio Speaker [17] Cubed Cases [18] model of the present invention, as fully attached and affixed mounted to by fastening ties [27] the requisite article of Jewelry of a Chain ornamental or genuine [25] the component connected by 2 Pin Connector parts [4][10] at [15][16] are now coated and sealed with Acrylic layers [28] although the Acrylic layers [28] can be any color [FIG. 15] is the present invention upon full completion.

FIG. 17 is an Upper Front View of a seven count identical Audio Speaker [17] in Cubed Cases [18] model of the present invention, as the selected component parts connected by their wire leads have formed an electrical wire harness at wire leads at [15][16] as by the connected to 2 Pin Connectors [04][10].

FIG. 18 is an Upper Front View of a seven count identical Audio Speaker [17] in Cubed Case [18] model of the present invention, with an optional branch [07] line-in microphone [08] as the electrical component parts connected by their wire leads [11][12][13][14] at [15][16] of 2 Pin Connectors [04][10] forming an electrical wire harness [FIG. 17][FIG. 18][FIG. 19].

DETAILED DESCRIPTION OF THE INVENTION

FIG. 19 is an Upper Front View of a seven count identical Audio Speaker [17] in Cubed Case [18] model of the present invention herein, with 2 female 3.5 mm Audio Jacks mono or stereo [09] as the selected component parts are connected by their wire leads [11][12][13][14] at [15][16] of 2 Pin Connectors [04][10] forming an electrical wire harness [FIG. 17][FIG. 18][FIG. 19].

The first named inventor for the present invention tentatively entitled "The Daisy Chained Audio Speaker System" teaches a wire harnessed connected series of identical or non-identical Audio Speakers. The term "Daisy Chained" is actually Computer language where separate and distinct machines become connected by a "SCSI" connector plug and wire interface, whereby a (1) Printer is connected to a (2) External Floppy Disk drive, and it to a (3) External CD/DVD Burner Drive, and each of these now "Daisy Chained Computer Peripherals" become connected by "SCSI" interface at the rear of a Computer at the installed "SCSI Card" interface thus providing full empowerment and acknowledgment and control of each of the separate machines that are made operable in such a "Daisy Chained" configuration.

The present invention component parts become electrically wire harnessed by all wire leads [05][06][11][12][13][14] at [15][16] as shown herein joined by 2 Pin Connectors [04][10]. The term "Harnessed" is a system of insulated conducting wires bound together in service upon a machine.

The selected numerical count of Audio Speakers [17][18] in the present invention example of 6 to 7 may be connected in a series or parallel electrical configuration. The term "series" means that the components are connected end-to-end in a line forming a single path for electrons to flow.

In a "series" electrical configuration, the amount of current is the same through any component in an electrical circuit connected across each components wire leads. The term "parallel" means that the component parts are connected across each other, forming exactly two sets of electrically common points [05][06][11][12][13][14] at [15][16]. The term "branch" in a parallel circuit is a path for electric current formed by one of the load components.

The present invention includes at least the following basic components: a selected numerical count of Audio Speakers [17][18], the harnessing of the electrical wire leads to form a series or parallel configuration at [15][16] with an optional branch [07], the requisite host of a jewelry chain ornamental or genuine [25] for the mounting and support by fastening ties [27] thus completion of the structure. The female or male 3.5 mm stereo or mono Jack [01][09] is the interface where externally connected is the required Audio Input signal empowering electrical current may be provided by such as an external Bluetooth Receiver/Transmitter or such as by a physical line-in Audio Source electrical input signal or as plugged into to a Mobile Device or a Portable Radio or CD Player or MP3 Player etc. The 3.5 mm stereo or mono Jack is the interface component for the present invention.

The dimensions of the component parts herein may vary, and as well the dimension of the requisite host of a Jewelry Chain ornamental or genuine [25] mounted to by fastening ties [27] for the support and completion of the structure [FIG. 15].

The junction of component parts wire leads at [15][16] of the present invention may be soldered together. Heat shrink and electrical tape may be used to seal and separate the soldered connection wire leads [03] and at [15][16]. The Audio Speakers [17] and the female or male 3.5 mm stereo or mono Jack [01][09] are modified herein example to each bear a 2 Pin connector female or male [04][10].

The connected component parts assembled then become attached and affixed mounted to by fastening ties [27] the requisite host of a Jewelry Chain ornamental or genuine [25] for the form and support and completion of this structure.

The length of the present invention herein may vary pursuant to the selected numerical count of Audio Speakers [17] and likewise shall the length of the requisite host of a Jewelry Chain ornamental or genuine [25] attached and affixed mounted to by fastening ties [27] for the form and support and completion of the structure.

The present invention is powered by the Electrical Voltage and Amplitude of the Audio Input Source signal. The present invention requires no electrical charge and no onboard power supply.

The present invention is controlled by the Electrical Voltage and Amplitude of the Audio Input Source signal, as the service of the end-user-chosen Audio Input source signal is maintained, and the Audio Input source signal is controlled at and from the Audio Input empowering source providing device externally connected by the end-user.

The requisite host of a Jewelry Chain ornamental or genuine [25] for the form and support and completion of the structure mounted to by fastening ties [27] herein may vary in design and in composite element and in value for the exploitation of the Jewelry Chain ornamental or genuine [25] supporting the completion of the structure herein.

An Example of the Daisy Chained Audio Speaker System as an Accessory:

The present invention as a Chain [FIG. 15] that completes a full neck circumference of the end-users neck. The "Daisy Chained Audio Speaker System" when in completion as mounted to by Fastening Ties [27] the Jewelry Chain ornamental or genuine [25] now greatly increases the value of both the jewelry chain and the present invention as exploited by the end-user.

FIGURE DESCRIPTIONS

Figure 1:
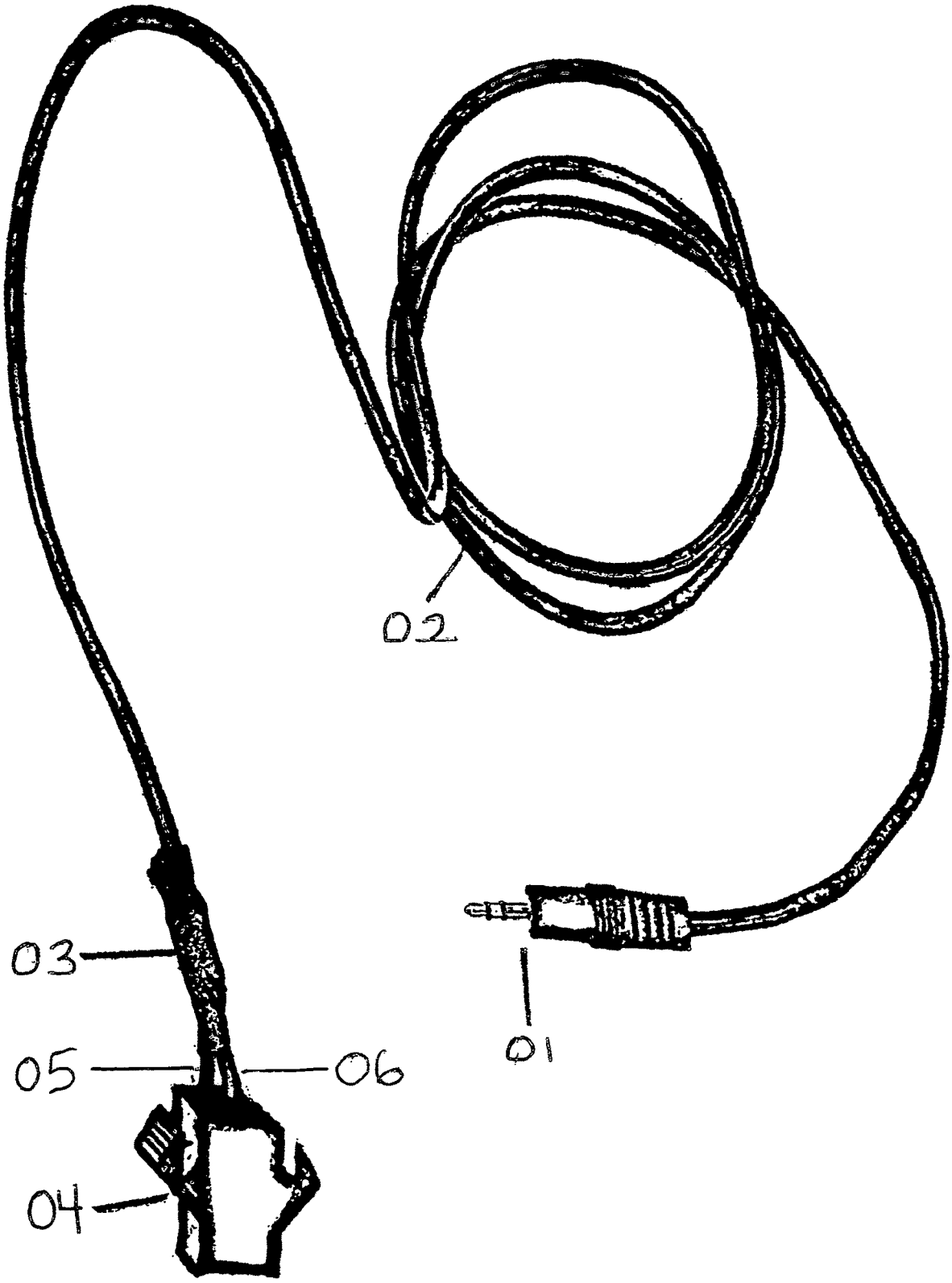
FIG. 1 is a 3.5 mm male Audio Jack mono or stereo [01] with a 3 ft. Wire [02] connected [03] to a male 2 Pin Connector's [04] wire leads [05][06] as all component parts are to become connected for the resulting completed electrical wire harnessed series [FIG. 17][FIG. 18][FIG. 19].
Figure 2:
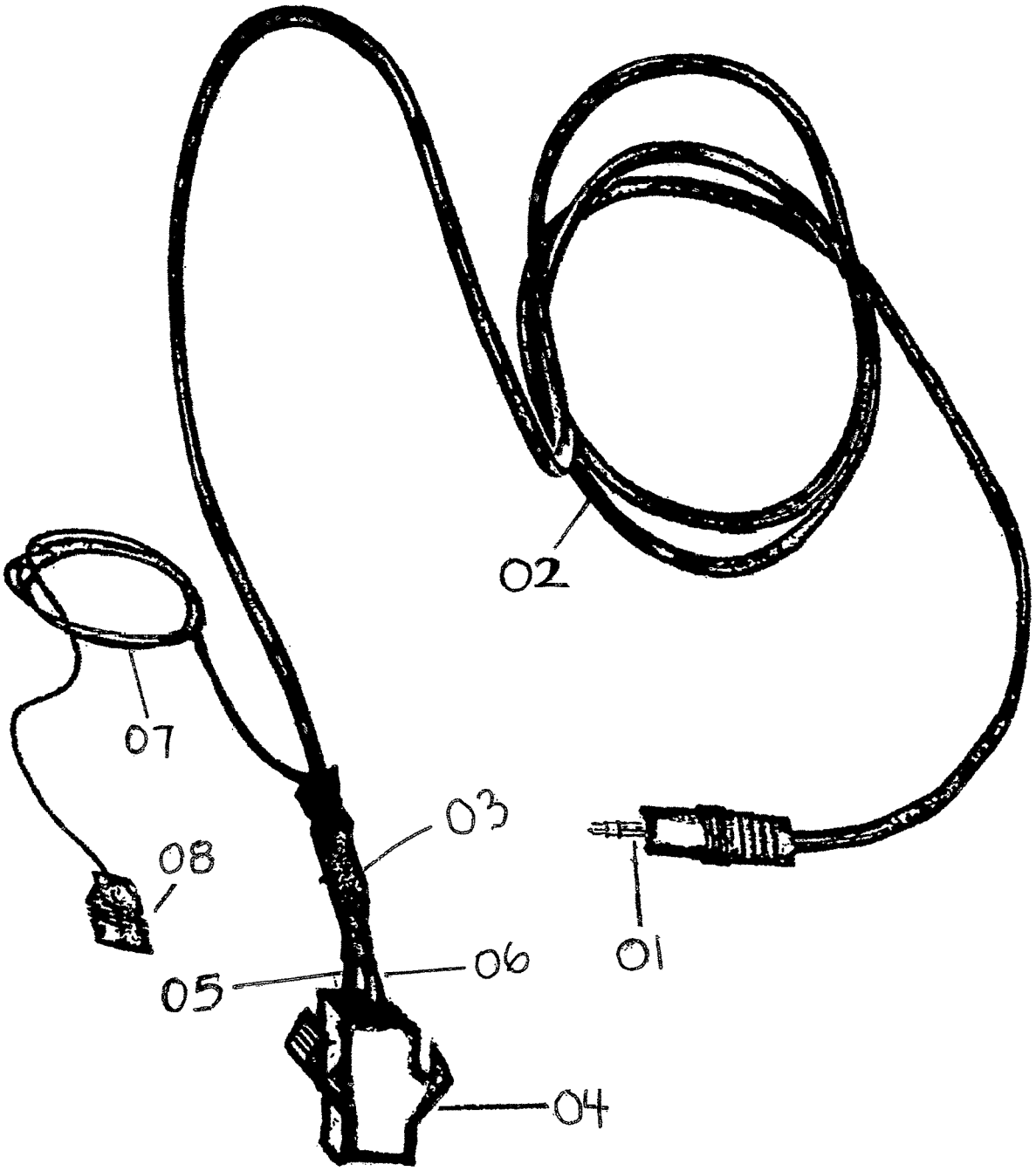
FIG. 2 is a 3.5 mm male Audio Jack mono or stereo [01] with a 3 ft.Wire [02] connected [03] to a male 2 Pin Connector's [04] wire leads [05][06] and an optional branch [07] line-in microphone [08] as all component parts are to become connected for the completed resulting electrical wire harnessed series [FIG. 17][FIG. 18][FIG. 19].
Figure 3:
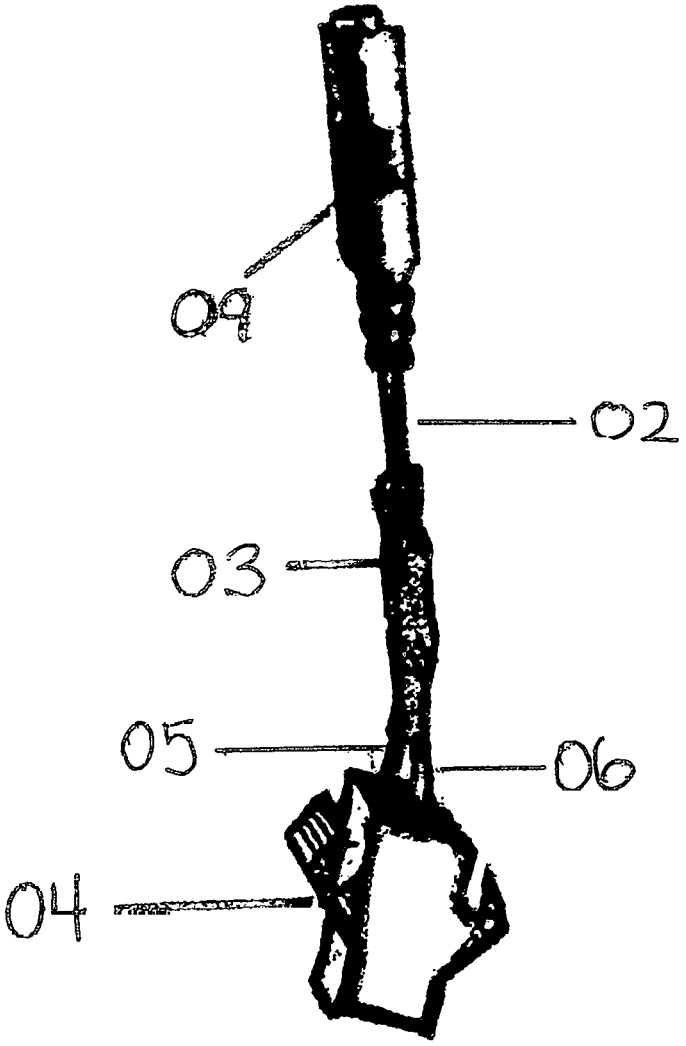
FIG. 3 is a 3.5 mm female Audio Jack mono or stereo [09] with a 3 inch Wire [02] connected [03] to a male 2 Pin Connector's [04] wire leads [05][06] as all parts are to become connected for the completed resulting electrical wire harnessed series [FIG. 17][FIG. 18][FIG. 19].
Figure 4:
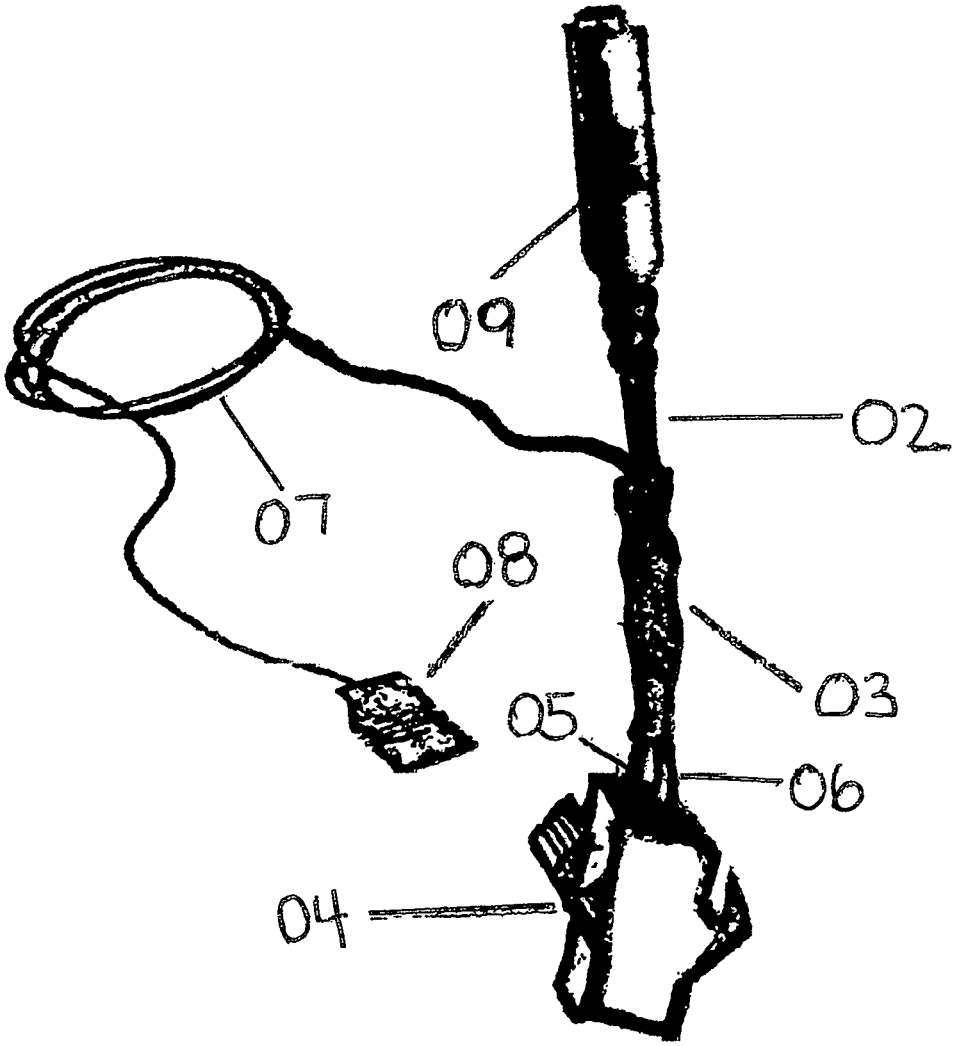
FIG. 4 is a 3.5 mm female Audio Jack mono or stereo [09] with a 3 inch Wire [02] connected to male 2 Pin Connector's wire leads [05][06] and an optional branch [07] line-in Microphone [08] as all component parts are to become connected for the completed resulting electrical wire harnessed series [FIG. 17][FIG. 18][FIG. 19].
Figure 5:
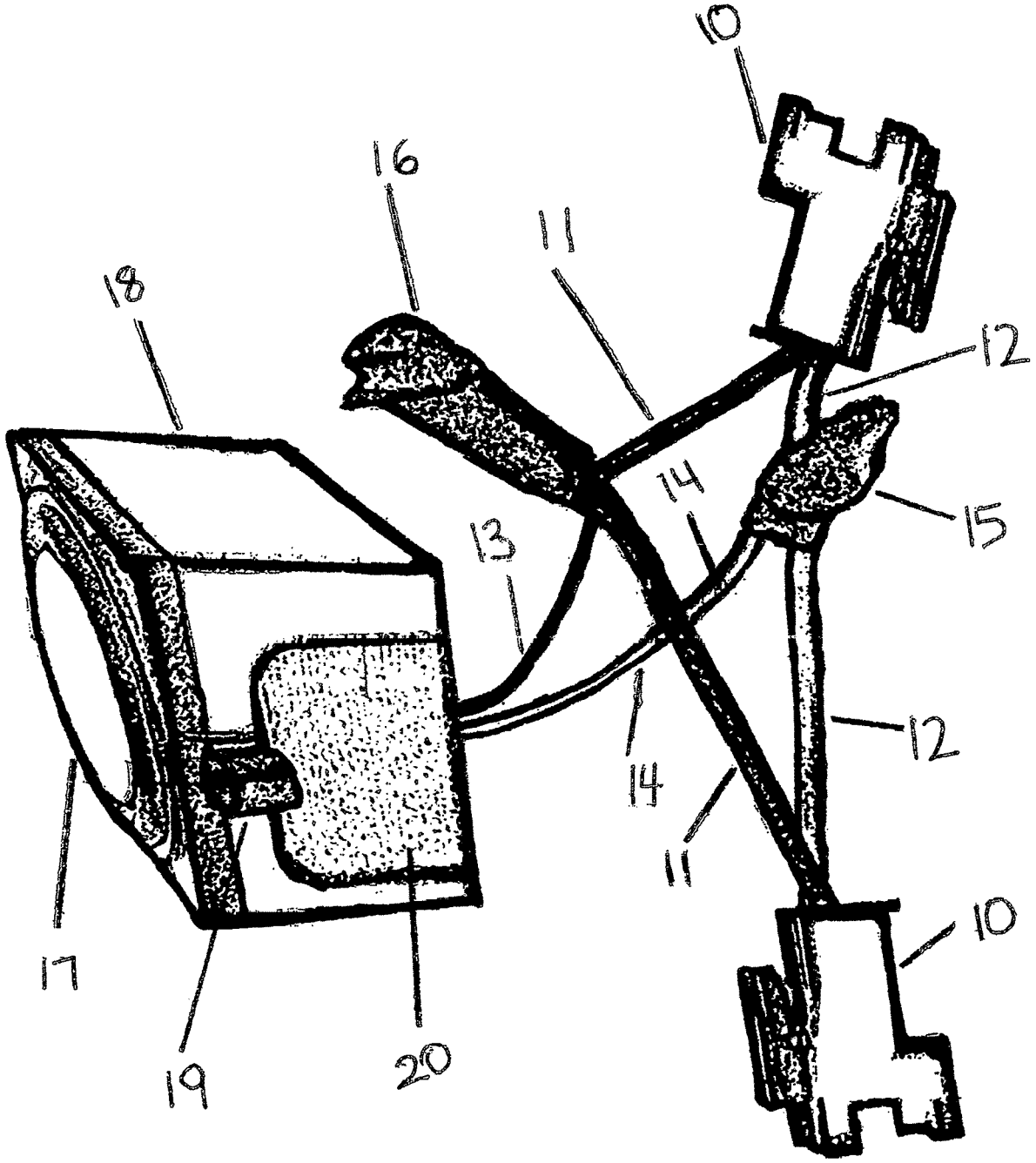
FIG. 5 is an Upper Front View of an Audio Speaker [17] in Cubed Case [18] connected by wire leads [13][14] to two female 2 Pin Connectors [10] by wire leads [11][12] at [15][16] as all component parts are to become connected for the resulting completed electrical wire harnessed series [FIG. 17][FIG. 18][FIG. 19].
Figure 6:
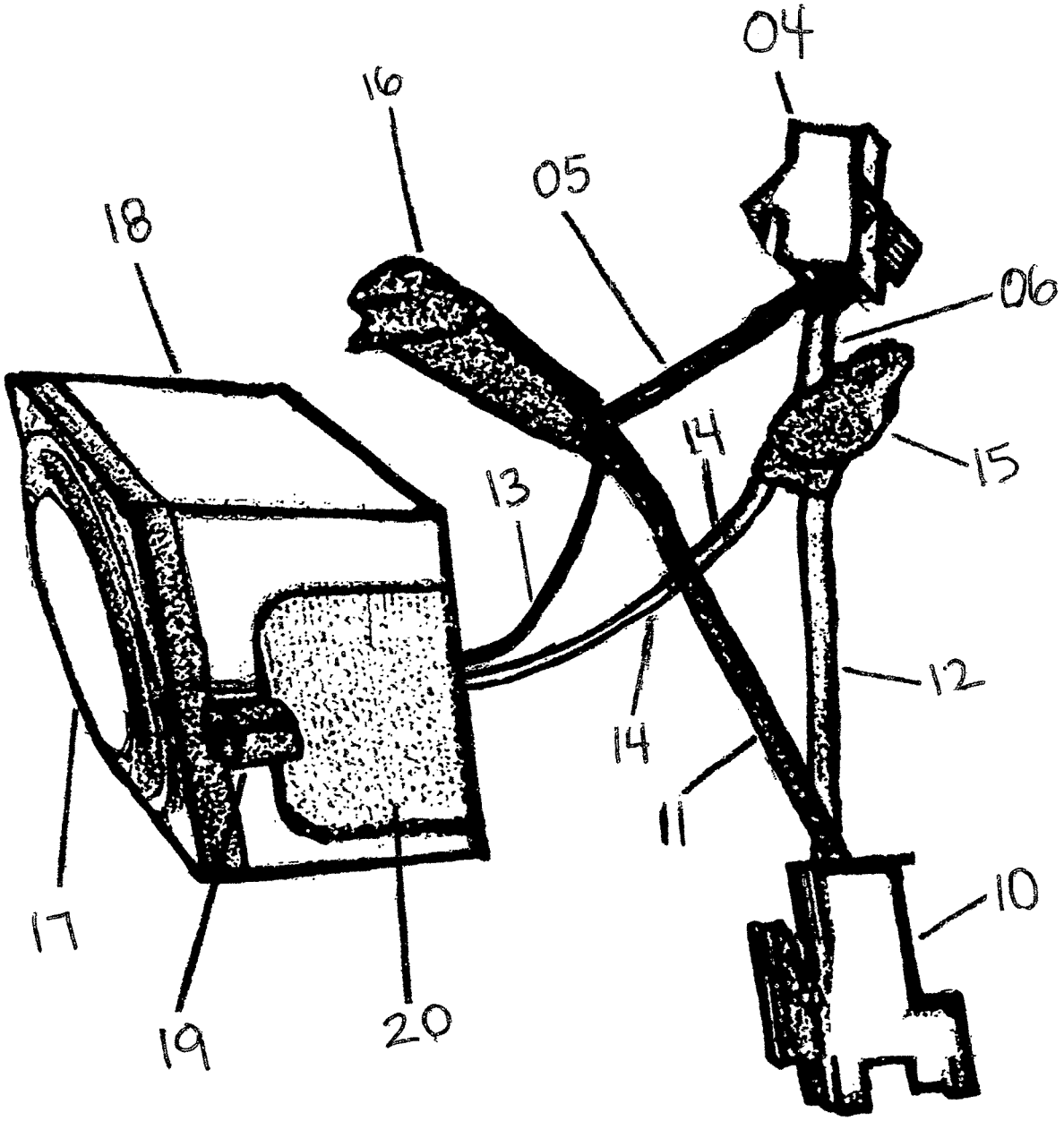
FIG. 6 is an Upper Front View of an Audio Speaker [17] in Cubed Case [18] connected by wire leads [13][14] to one female 2 Pin Connector [10] by wire leads [11][12] and to one male 2 Pin Connector [04] by wire leads [05][06] at [15][16] as all component parts are to become connected for the resulting completed electrical wire harnessed series [FIG. 17][FIG. 18][FIG. 19].
Figure 7:
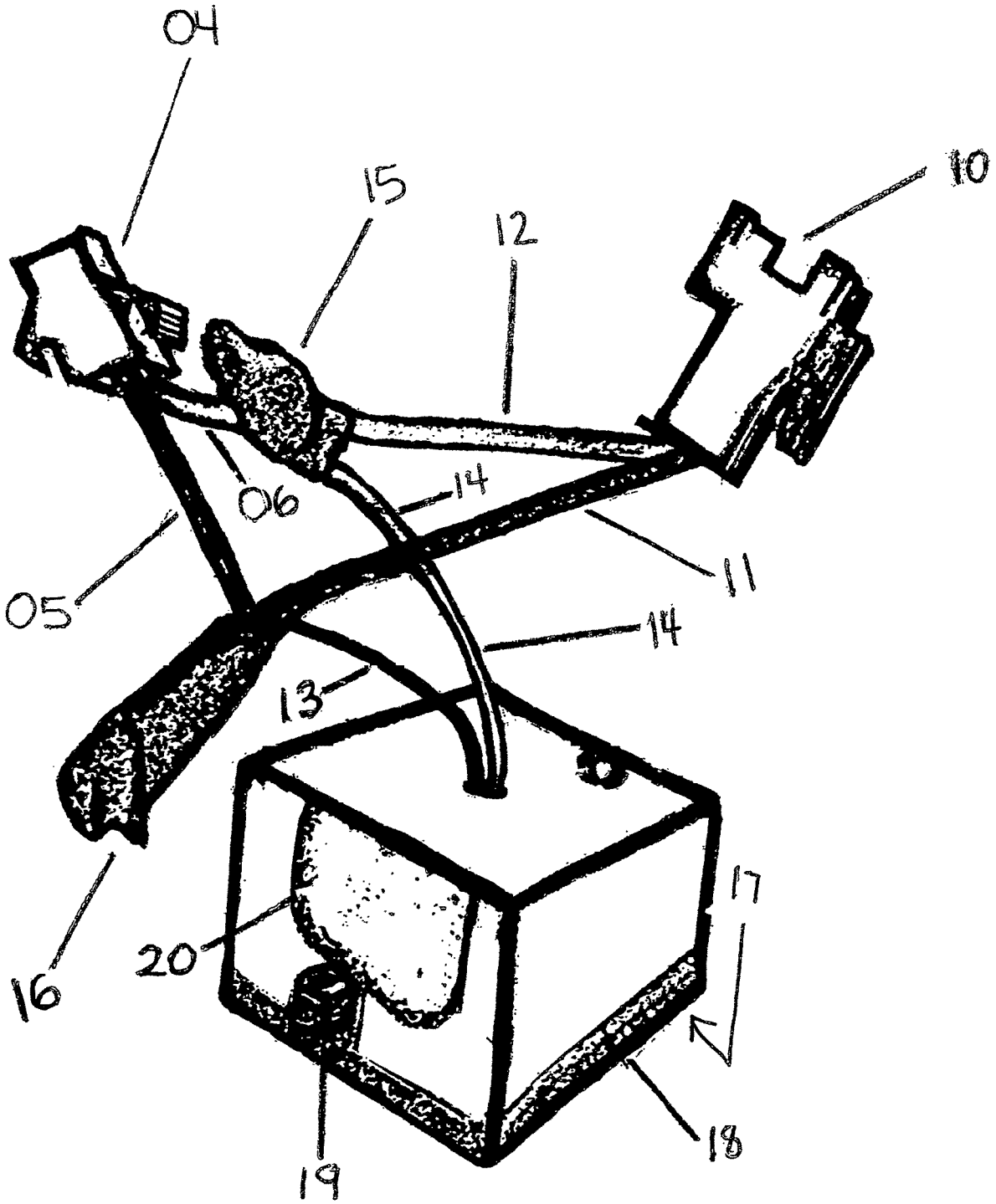
FIG. 7 is an Upper Rear View of an Audio Speaker [17] in Cubed Case [18] connected by wire leads [13][14] to one female 2 Pin Connector [10] by wire leads [11][12] to one male 2 Pin Connector [04] by wire leads [05][06] at [15][16] as all component parts are to become connected for the resulting completed electrical wire harnessed series [FIG. 17][FIG. 18][FIG. 19].

FIG. 1 of 19
[01] 3.5 mm male Audio Jack mono or stereo
[02] Wire of Audio Jack mono or stereo
[03] Bundled wire connection of [04] male 2 Pin Connector to [02] Wire of Audio Jack mono or stereo
[04] male 2 Pin Connector
[05] Negative wire lead of [04] male 2 Pin Connector
[06] Positive wire lead of [04] male 2 Pin Connector
[01] 3.5 mm male Audio Jack mono or stereo
[02] Wire of Audio Jack mono or stereo
[03] Bundled wire connection of [04] male 2 Pin Connector to [02] Wire of Audio Jack mono or stereo
[04] male 2 Pin Connector
[05] Negative wire lead of [04] male 2 Pin Connector
[06] Positive wire lead of [04] male 2 Pin Connector
[07] Wire lead of [08] Microphone
[08] Microphone
FIG. 3 of 19
[02] Wire of Audio Jack mono or stereo
[03] Bundled wire connection of [04] male 2 Pin Connector to [02] Wire of Audio Jack mono or stereo
[09] 3.5 mm female Audio Jack mono or stereo
[04] male 2 Pin Connector
[05] Negative wire lead of [04] male 2 Pin Connector
[06] Positive wire lead of [04] male 2 Pin Connector
FIG. 4 of 19
[02] Wire of Audio Jack mono or stereo
[03] Bundled wire connection of [04] male 2 Pin Connector to [02] Wire of Audio Jack mono or stereo
[09] 3.5 mm female Audio Jack mono or stereo
[04] male 2 Pin Connector
[05] Negative wire lead of [04] male Pin Connector
[06] Positive wire lead of [04] male 2 Pin Connector
[07] Wire lead of [08] Microphone
[08] Microphone
FIG. 5 of 19
[10] female 2 Pin Connector
[11] Negative wire lead of [10] female 2 Pin Connector
[12] Positive wire lead of [10] female 2 Pin Connector
[13] Negative wire lead of [17] Audio Speaker
[14] Positive wire lead of Audio [17] Speaker
[15] Bundled wire connection of [10] female 2 Pin Connector [12] Positive wire lead to [10] female 2 Pin Connector [12] Positive wire lead to [14] Positive wire lead of [17] Audio Speaker
[16] Bundled wire connection of [10] female 2 Pin Connector [11] Negative wire lead to [10] female 2 Pin Connector [11] Negative wire lead to [13] Negative wire lead of [17] Audio Speaker
[17] Audio Speaker
[18] Audio Speaker Cubed Case
[19] Holed mounting digit upon [18] Audio Speaker Cubed Case
[20] Fabric attachment pad one sheet
FIG. 6 of 19
[04] male 2 Pin Connector
[05] Negative wire lead of [04] male 2 Pin. Connector
[06] Positive wire lead of [04] male 2 Pin Connector
[10] female 2 Pin Connector
[11] Negative wire lead of [10] female 2 Pin Connector
[12] Positive wire lead of [10] female 2 Pin Connector
[13] Negative wire lead of [17] Audio Speaker
[14] Positive wire lead of [17] Audio Speaker
[15] Bundled wire connection of [10] female 2 Pin Connector [12] Positive wire lead to [04] male 2 Pin Connector [06] Positive wire lead to [14] Positive wire lead of [17] Audio Speaker
[16] Bundled wire connection of [10] female 2 Pin Connector [11] Negative wire lead to [04] male 2 Pin Connector [05] Negative wire lead to [13] Negative wire lead of [17] Audio Speaker
[18] Audio Speaker Cubed Case
[17] Audio Speaker
[19] Holed mounting digit upon [18] Audio Speaker Cubed Case
[20] Fabric attachment pad one sheet
FIG. 7 of 19
[04] male 2 Pin Connector
[05] Negative wire lead of [04] male 2 Pin Connector
[06] Positive wire lead of [04] male 2 Pin Connector
[10] female 2 Pin Connector
[11] Negative wire lead of [10] female 2 Pin Connector
[12] Positive wire lead of [10] female 2 Pin Connector
[13] Negative wire lead of [17] Audio Speaker
[14] Positive wire lead of [17] Audio Speaker
[15] Bundled wire connection of [10] female 2 Pin Connector [12] Positive wire lead to
[04] male 2 Pin Connector [06] Positive wire lead to[14] Positive wire lead of [17] Audio Speaker
[13] Negative wire lead of [17] Audio Speaker
[16] Bundled wire connection of [10] female 2 Pin Connector [11] Negative wire lead to
[04] male 2 Pin Connector [05] Negative wire lead to [13] Negative wire lead of [17] Audio Speaker
[18] Audio Speaker Cubed Case
[17] Audio Speaker
[19] Holed mounting digit upon [18] Audio Speaker Cubed Case

Figure 8:
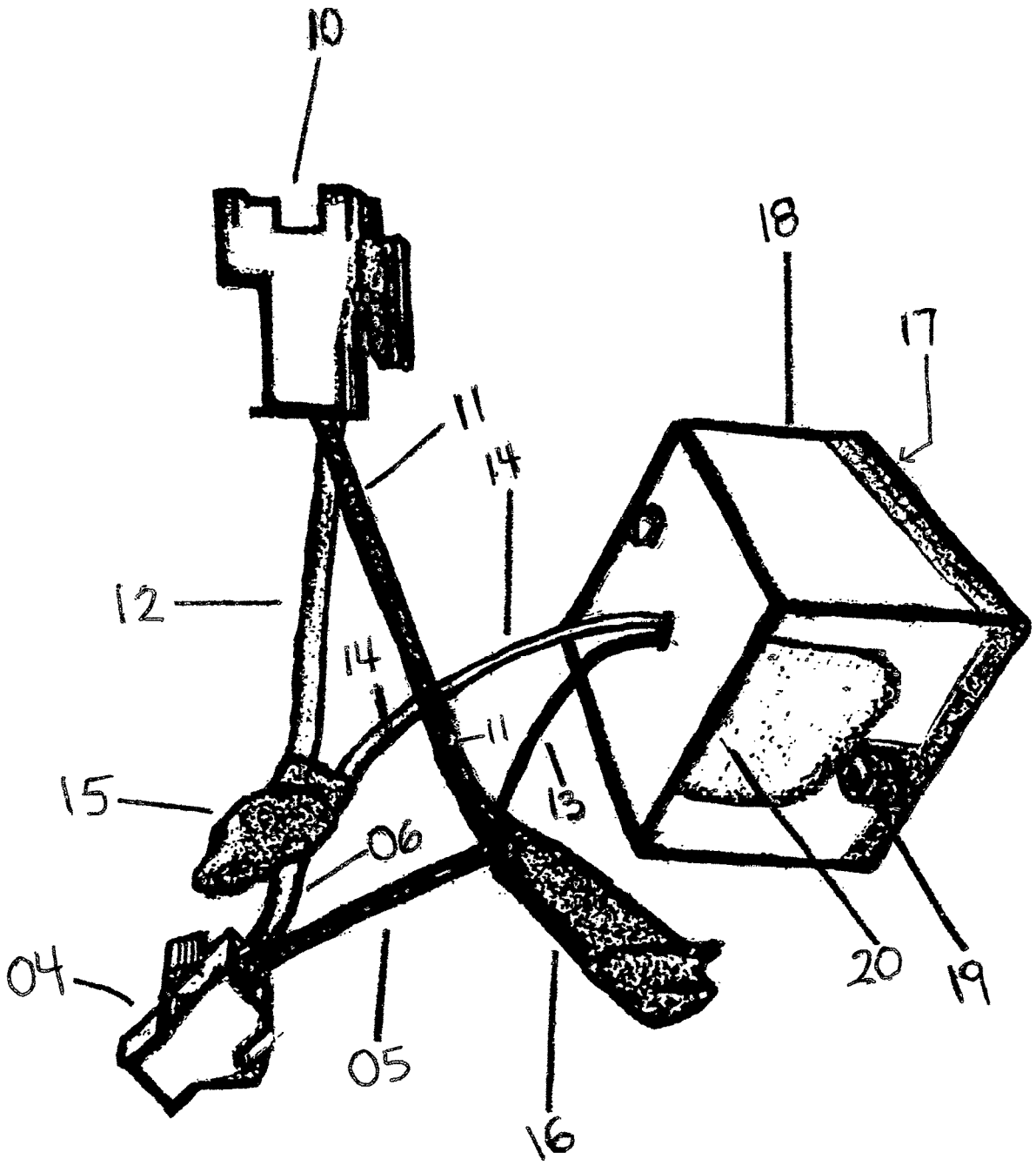
FIG. 8 is an Upper Rear View of another identical Audio Speaker [17] in Cubed Case [18] connected by wire leads [13][14] to one female 2 Pin Connector [10] by wire leads [11][12] and to one male 2 Pin Connector [04] by wire leads [05][06] at [15][16] as all component parts are to become connected for the resulting completed electrical wire harnessed series [FIG. 17][FIG. 18][FIG. 19].
Figure 9:
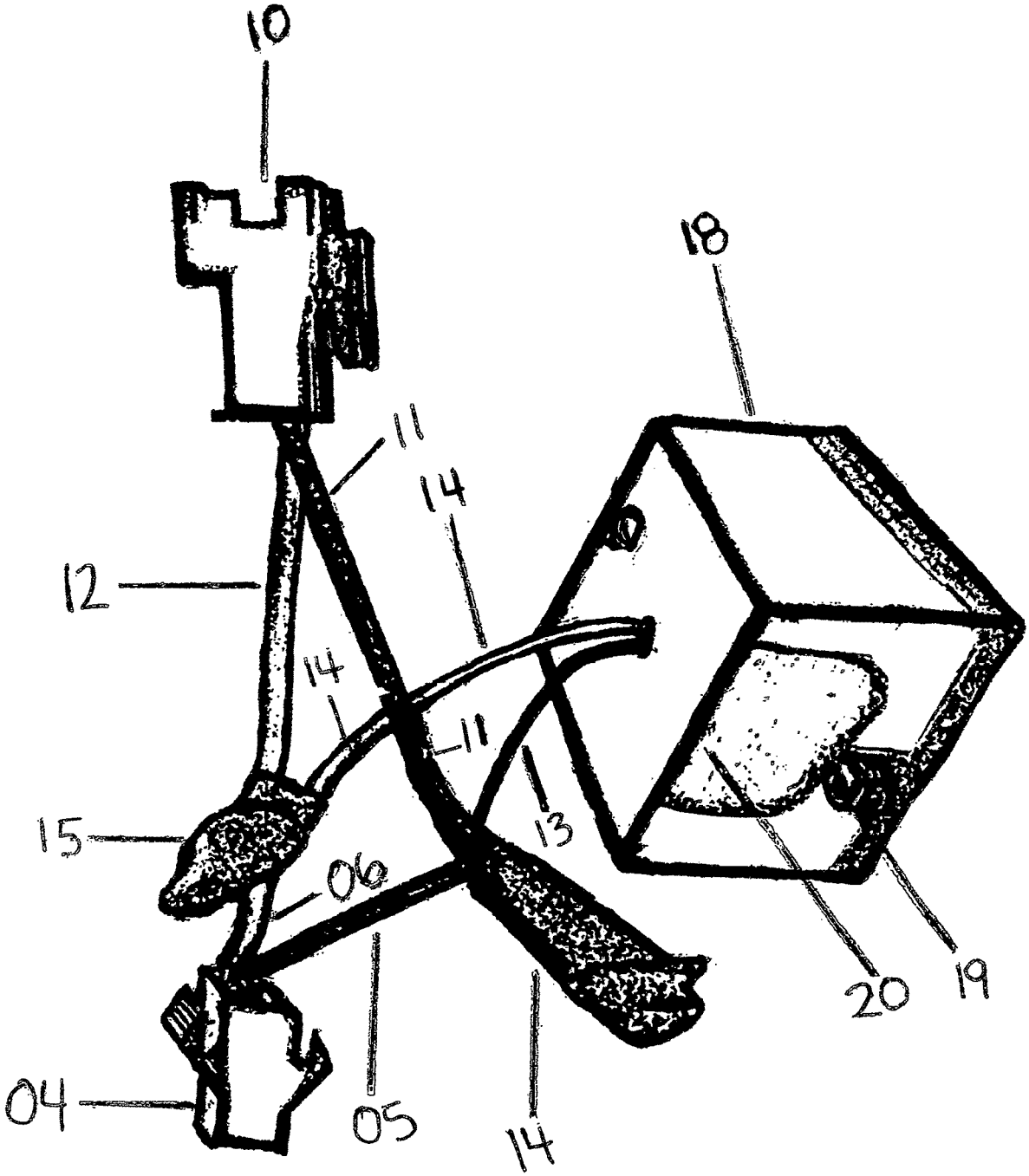
FIG. 9 is an Upper Rear View of another identical Audio Speaker [17] in Cube Case [18] connected by wire leads [13][14] to one female 2 Pin Connector [10] by wire leads [11][12] and to one male 2 Pin Connector [04] wire leads [05][06] at [15][16] as all component parts are to become connected for the resulting completed electrical wire harnessed series [FIG. 17][FIG. 18][FIG. 19].
Figure 10:
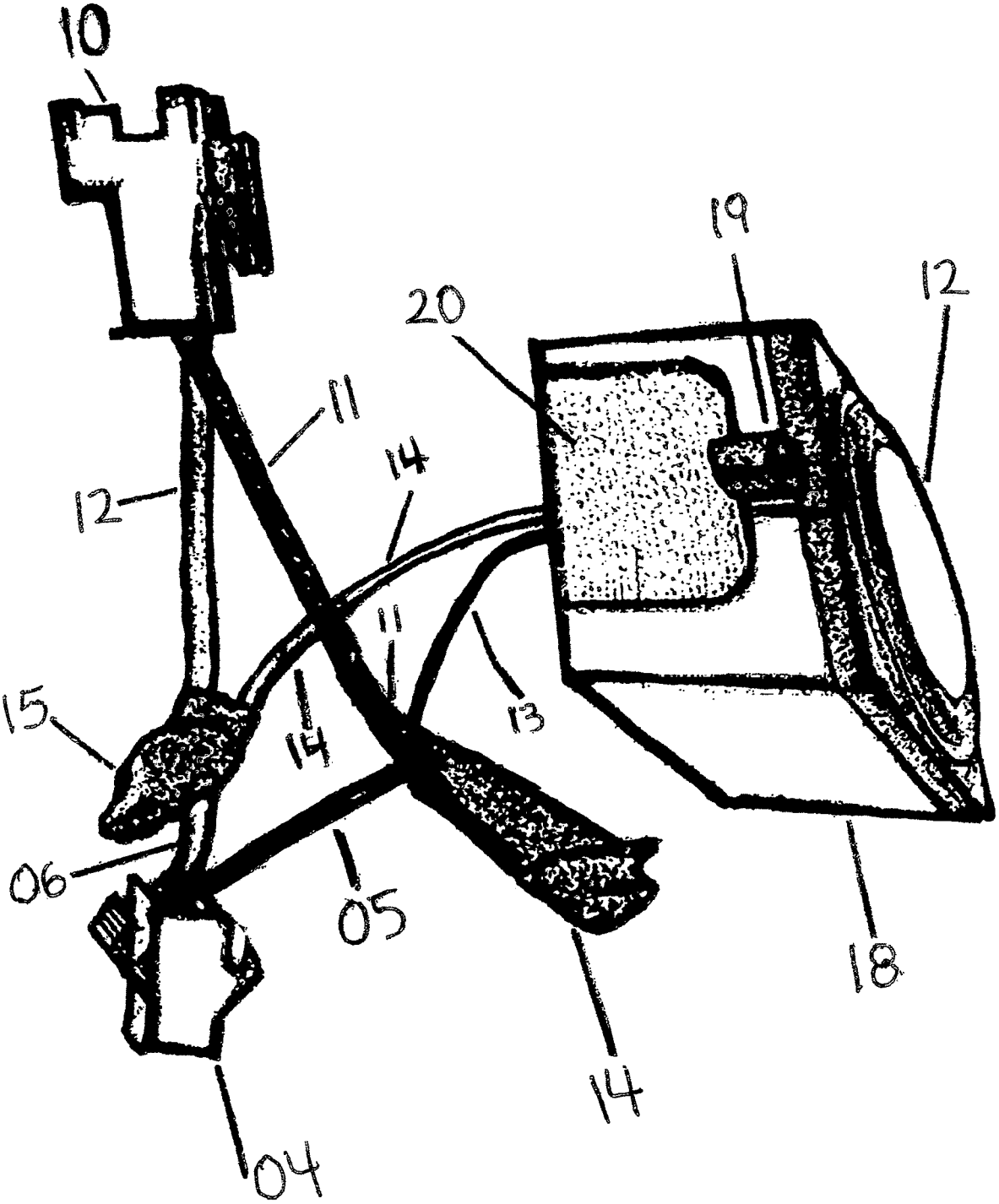
FIG. 10 is an Upper Front View of another identical Audio Speaker [17] in Cubed Case [18] connected by wire leads [13][14] to one female 2 Pin Connector [10] by wire leads [11][12] and to one male 2 Pin Connector [04] by wire leads

[20] Fabric attachment pad one sheet
FIG. 8 of 19
[04] male 2 Pin Connector
[05] Negative wire lead of [04] male 2 Pin Connector
[06] Positive wire lead of [04] male 2 Pin Connector
[10] female 2 Pin Connector
[11] Negative wire lead of [10] female 2 Pin Connector
[12] Positive wire lead of [10] female 2 Pin Connector
[13] Negative wire lead of [17] Audio Speaker
[14] Positive wire lead of [17] Audio Speaker
[15] Bundled wire connection of [10] female 2 Pin Connector [11] Positive wire lead to [04] male 2 Pin Connector [06] Positive wire lead to [14] Positive wire lead of [17] Audio Speaker
[16] Bundled wire connection of [10] female 2 Pin Connector [05] Negative wire lead of [04] male 2 Pin Connector to [05] Negative wire lead to [13] Negative wire lead of [17] Audio Speaker
[18] Audio Speaker Cubed Case
[19] Holed mounting digit upon [18] Audio Speaker Cubed Case
[20] Fabric attachment pad one sheet
FIG. 9 of 19
[04] male 2 Pin Connector
[05] Negative wire lead of [04] male 2 Pin Connector
[06] Positive wire lead of [04] male 2 Pin Connector
[10] female 2 Pin Connector
[11] Negative wire lead of [10] female 2 Pin Connector
[12] Positive wire lead of [10] female 2 Pin Connector
[13] Negative wire lead of [17] Audio Speaker
[14] Positive wire lead of [17] Audio Speaker
[15] Bundled wire connection of [10] female 2 Pin Connector [12] Positive wire lead to [04] male 2 Pin Connector [06] Positive wire lead to [14] Positive wire lead of [17] Audio Speaker
[16] Bundled wire connection of [10] female 2 Pin Connector [05] Negative wire lead of [04] male 2 Pin Connector to [05] Negative wire lead to [13] Negative wire lead of [17] Audio Speaker
[18] Audio Speaker Cubed Case
[19] Holed mounting digit upon [18] Audio Speaker Cubed Case
[20] Fabric attachment pad one sheet
FIG. 10 of 19
[04] male 2 Pin Connector
[05] Negative wire lead of [04] male 2 Pin Connector
[06] Positive wire lead of [04] male 2 Pin Connector
[10] female 2 Pin Connector
[11] Negative wire lead of [10] female 2 Pin Connector
[12] Positive wire lead of [10] female 2 Pin Connector
[13] Negative wire lead of [17] Audio Speaker
[14] Positive wire lead of [17] Audio Speaker
[15] Bundled wire connection of [10] female 2 Pin Connector [12] Positive wire lead to [04] male 2 Pin Connector [06] Positive wire lead to [14] Positive wire lead of [17] Audio Speaker
[16] Bundled wire connection of [10] female 2 Pin Connector to [05] Negative wire lead of [04] male 2 Pin Connector to [05] Negative wire lead to [13] Negative wire lead of [17] Audio Speaker
[18] Audio Speaker Cubed Case
[17] Audio Speaker
[19] Holed mounting digit upon [18] Audio Speaker Cubed Case
[20] Fabric attachment pad one sheet
FIG. 11 of 19
[04] male 2 Pin Connector
[05] Negative wire lead of [04] male 2 Pin Connector
[06] Positive wire lead of [04] male 2 Pin Connector
[10] female 2 Pin Connector
[11] Negative wire lead of [10] female 2 Pin Connector
[12] Positive wire lead of [10] female 2 Pin Connector
[13] Negative wire lead of [17] Audio Speaker
[14] Positive wire lead of [17] Audio Speaker
[15] Bundled wire connection of [10] female 2 Pin Connector [12] Positive wire lead to [04] male 2 Pin Connector [06] Positive wire lead to [14] Positive wire lead of Audio [17] Speaker
[16] Bundled wire connection of [10] female 2 Pin Connector [11] Negative wire lead of [04] male 2 Pin Connector [05] Negative wire lead to [13] Negative wire lead of [17] Audio Speaker
[12] Positive wire lead of [17] Audio Speaker
[18] Audio Speaker Cubed Case
[17] Audio Speaker
[19] Holed mounting digit upon [18] Audio Speaker Cubed Case
[20] Fabric attachment pad one sheet
[21] Electrical tape
FIG. 12 of 19
[04] male 2 Pin Connector
[05] Negative wire lead of [04] male 2 Pin Connector
[06] Positive wire lead of [04] male 2 Pin Connector
[10] female 2 Pin Connector
[11] Negative wire lead of [10] female 2 Pin Connector
[12] Positive wire lead of [10] female 2 Pin Connector
[13] Negative wire lead of [17] Audio Speaker
[14] Positive wire lead of [17] Audio Speaker
[15] Bundled wire connection of [10] female 2 Pin Connector [12] Positive wire lead to [04] male 2 Pin Connector [06] Positive wire lead to [14] Positive wire lead of [17] Audio Speaker
[16] Bundled wire connection of [10] female 2 Pin Connector [11] Negative wire lead of [04] male 2 Pin Connector to [13] Negative wire lead of [17] Audio Speaker
[16] Bundled wire connection of [10] female and or [04] male 2 Pin Connector to
[18] Audio Speaker Cubed Case
[21] Electrical tape
[29] Flexible plastic tube optional or [28] Acrylic layers
[24] Foam Cushion Pad
FIG. 13 of 19
[23] Semi-Circle crossbar
FIG. 14 of 19
[04] male 2 Pin Connector
[10] female 2 Pin Connector
[18] Audio Speaker Cubed Case
[17] Audio Speaker
[20] Fabric attachment pad one sheet
[21] Electrical tape
[29] Flexible plastic tube optional or [028] Acrylic layers
[24] Foam Cushion Pad
[25] Article of jewelry of a Chain ornamental or genuine
[27] Fastening tie
[19] Holed mounting digit upon [18] Audio Speaker Cubed Case
FIG. 15 of 19
[04] male 2 Pin Connector
[10] female 2 Pin Connector
[11] Negative wire lead of [10] female 2 Pin Connector
[12] Positive wire lead of [10] female 2 Pin Connector
[18] Audio Speaker Cubed Case
[17] Audio Speaker
[23] Semi Circle crossbar maintaining semi-circular form

[25] Article of jewelry of a Chain ornamental or genuine
[28] Acrylic layers
[26] Clasp plastic hooks
FIG. 16 of 19
[18] Audio Speaker Cubed Case coated with [28] Acrylic layers
[21] Electrical tape shown not coated with [28] Acrylic layers
[24] Foam Cushion Pad
[23] Semi Circle crossbar maintaining semi-circular form
[25] Article of jewelry of a Chain ornamental or genuine
[28] Acrylic layers
[29] Clasp plastic hooks
FIG. 17 of 19
[01] 3.5 mm male Audio Jack mono or stereo
[02] Wire of Audio Jack mono or stereo
[03] Bundled wire connection
[04] male 2 Pin Connector
[05] Negative wire lead of [04] male 2 Pin Connector
[06] Positive wire lead of [04] male 2 Pin Connector
[10] female 2 Pin Connector
[11] Negative wire lead of [10] female 2 Pin Connector
[12] Positive wire lead of [10] female 2 Pin Connector
[13] Negative wire lead of [17] Audio Speaker
[14] Positive wire lead of [17] Audio Speaker
[15] Bundled wire connection
[16] Bundled wire connection
[18] Audio Speaker Cubed Case
[17] Audio Speaker
[19] Holed mounting digit upon [18] Audio Speaker Cubed Case
[20] Fabric attachment pad one sheet
FIG. 18 of 19
[01] 3.5 mm male Audio Jack mono or stereo
[02] Wire of Audio Jack mono or stereo
[03] Bundled wire connection
[04] male 2 Pin Connector
[05] Negative wire lead of [04] male 2 Pin Connector
[06] Positive wire lead of [04] male 2 Pin Connector
[07] Wire of [08] Microphone
[08] Microphone
[09] 3.5 mm female Audio jack mono or stereo
[10] female 2 Pin Connector
[11] Negative wire lead of [10] female 2 Pin Connector
[12] Positive wire lead of [10] female 2 Pin Connector
[13] Negative wire lead of [17] Audio Speaker
[14] Positive wire lead of Audio [17] Speaker
[15] Bundled wire connection
[13] Negative wire lead of [17] Audio Speaker
[16] Bundled wire connection
[14] Positive wire lead of [17] Audio Speaker
[18] Audio Speaker Cubed Case
[17] Audio Speaker
[19] Holed mounting digit upon [18] Audio Speaker Cubed Case
[20] Fabric attachment pad one sheet
FIG. 19 of 19
[02] Wire of Audio Jack mono or stereo
[03] Bundled wire connection
[09] female Audio Jack mono or stereo
[04] male 2 Pin Connector
[05] Negative wire lead of [04] male 2 Pin Connector
[06] Positive wire lead of [04] male 2 Pin Connector
[09] 3.5 mm female Audio jack mono or stereo
[10] female 2 Pin Connector
[11] Negative wire lead of [10] female 2 Pin Connector
[12] Positive wire lead of [10] female 2 Pin Connector
[13] Negative wire lead of [17] Audio Speaker
[14] Positive wire lead of Audio [17] Speaker
[15] Bundled wire connection
[13] Negative wire lead of [17] Audio Speaker
[16] Bundled wire connection
[18] Audio Speaker Cubed Case
[17] Audio Speaker
[19] Holed mounting digit upon [18] Audio Speaker Cubed Case
[20] Fabric attachment pad one sheet

I claim:

1. A Daisy Chained Audio Speaker System comprising:

A plurality of audio speakers in cube cases with each cubed case attached a foam cushion pad wherein at end of the plurality is an electrical empowering voltage and amplitude audio input source line in wire comprising an audio jack wherein each audio speaker comprises:

audio speaker [17] each in cubed case [18] with each cubed case attached a foam cushion pad [24] with each audio speaker connected by respective positive [14] and negative [13] wire leads to female [10] or male [04] 2 pin connectors;

wherein female [10] or male [04] 2 pin connector connects to the respective positive [06] and negative [05] and ground wire leads of the electrical empowering voltage and amplitude audio input source line in wire [02] comprising a male [01] or [09] female audio jack;

wherein the plurality of audio speakers in cube cases and the at end electrical empowering voltage and amplitude audio input source line in wire 2 pin connectors appropriately conjoin forming an electrically wire harnessed in parallel or in series daisy chain of components;

wherein the plurality of audio speakers in cube cases positive [14] and negative [13] wire leads and the respective positive [06] and negative [05] and ground wire leads of the at end electrical empowering voltage and amplitude audio input source line in wire comprising the male or female audio jack may be soldered for forming an electrically wire harnessed in parallel or in series daisy chain of components;

wherein each of the audio speakers in cube cases in the plurality are configured spaced apart secured to an article of ornamental costume or genuine jewelry chain by tie wherein the jewelry chain is configured to be worn around the neck of a person; and wherein the at end electrical empowering voltage and amplitude audio input source line in wire comprising a male or female audio jack is configured to connect to an electrical empowering voltage and amplitude audio input source device.

* * * * *